US007567141B2

(12) United States Patent
Kawanami

(10) Patent No.: US 7,567,141 B2
(45) Date of Patent: Jul. 28, 2009

(54) NONRECIPROCAL CIRCUIT DEVICE AND COMMUNICATION APPARATUS

(75) Inventor: Takashi Kawanami, Ishikawa-gun (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 309 days.

(21) Appl. No.: 11/558,010

(22) Filed: Nov. 9, 2006

(65) Prior Publication Data

US 2007/0063784 A1 Mar. 22, 2007

Related U.S. Application Data

(63) Continuation of application No. PCT/JP2006/303396, filed on Feb. 24, 2006.

(30) Foreign Application Priority Data

Mar. 4, 2005 (JP) ..... 2005-060096

(51) Int. Cl.
*H01P 1/383* (2006.01)
*H01P 1/36* (2006.01)

(52) U.S. Cl. ..... 333/1.1; 333/24.2

(58) Field of Classification Search ..... 333/1.1, 333/24.2

See application file for complete search history.

(56) References Cited

U.S. PATENT DOCUMENTS 6,765,453 B2 * 7/2004 Yamaguchi et al. ..... 333/24.2

FOREIGN PATENT DOCUMENTS

JP 07-202465 A 8/1995
JP 8-148907 A 6/1996
JP 08-172303 A 7/1996
JP 10-270911 A 10/1998
JP 2002-198707 A 7/2002
JP 2002-232211 A 8/2002

OTHER PUBLICATIONS

Official Communication issued in the corresponding International Application No. PCT/JP2006/303396, mailed on Apr. 11, 2006.

Official communication issued in counterpart Japanese Application No. 2007-505886, mailed on Mar. 3, 2009.

* cited by examiner

*Primary Examiner*—Stephen E Jones
(74) *Attorney, Agent, or Firm*—Keating & Bennett, LLP

(57) ABSTRACT

A nonreciprocal circuit device includes permanent magnets, a ferrite core to which a DC magnetic field is applied from the permanent magnets, center electrodes disposed on the ferrite core, a circuit substrate, a magnetic yoke, and an electromagnetic shield plate. The ferrite core and the permanent magnets are longitudinally disposed on the circuit substrate, and the yoke has a ring-like shape so as to surround side surfaces of the ferrite core and the permanent magnets. The electromagnetic shield plate includes a dielectric substrate and a shield conductor made of a nonmagnetic metal conductive film on the dielectric substrate. The shield conductor includes opening areas having slits.

19 Claims, 10 Drawing Sheets

NONRECIPROCAL CIRCUIT DEVICE AND COMMUNICATION APPARATUS

BACKGROUND OF THE INVENTION

1. Field of the Invention

The present invention relates to nonreciprocal circuit devices, and particularly, to a nonreciprocal circuit device, such as an isolator and a circulator, operating in a microwave band and a communication apparatus including the nonreciprocal circuit device.

2. Description of the Related Art

In the related art, a nonreciprocal circuit device, such as an isolator or a circulator, sends signals only in a predetermined particular direction and not in a direction opposite to the predetermined particular direction. By making use of this characteristic, an isolator, for example, is used for a transmission circuit in a mobile communication apparatus, such as an automobile telephone or a cellular telephone.

Japanese Unexamined Patent Application Publication No. 2002-198707 (Patent Document 1) discloses a nonreciprocal circuit device including a ferrite core wound with copper wires that is longitudinally disposed in the perpendicular direction as a center electrode on a circuit substrate so that two permanent magnets sandwich the ferrite core.

In the nonreciprocal circuit device disclosed in Patent Document 1, however, since the ferrite core and the permanent magnets are surrounded by a magnetic yoke not only from the four sides but also from above, a DC magnetic field applied to the ferrite core from the permanent magnets is dispersed on the upper surface of the yoke. This causes a problem in that a uniform DC magnetic field cannot be applied to the ferrite core.

In addition, Patent Document 1 discloses that a hole is provided at a center portion of the upper surface of the magnetic yoke. However, since the magnetic yoke defines a magnetic circuit having a DC magnetic field, the yoke provided with the hole deteriorates uniform magnetic field strength and weakens the DC magnetic field. Furthermore, the hole is configured to include an entire planar projection area of the ferrite core, resulting in considerable leakage of a high-frequency magnetic field.

SUMMARY OF THE INVENTION

To overcome the problems described above, preferred embodiments of the present invention provide a nonreciprocal circuit device which optimally maintains a stable DC magnetic field, eliminates external magnetic influences, and prevents unnecessary radiation (leakage) of electromagnetic waves to the outside, and a communication apparatus including such a novel nonreciprocal circuit device.

A nonreciprocal circuit device according to a preferred embodiment of the present invention includes permanent magnets, a ferrite core to which a DC magnetic field is applied from the permanent magnets, a plurality of center electrodes disposed on the ferrite core, a circuit substrate, and a magnetic yoke.

The plurality of center electrodes are disposed on main surfaces of the ferrite core so as to intersect with one another and are electrically insulated from one another.

The ferrite core and the permanent magnets are disposed so that main surfaces thereof face each other and are substantially perpendicular to a surface of the circuit substrate.

The magnetic yoke has a ring-like shape so as to surround the ferrite core and the permanent magnets with surfaces thereof that are substantially perpendicular to the surface of the circuit substrate.

A shield conductor made of a nonmagnetic metal conductive material is disposed directly above the ferrite core and the permanent magnets to cover an opening portion of the magnetic yoke.

In the nonreciprocal circuit device according to preferred embodiments of the present invention, the magnetic yoke defining a magnetic circuit having the DC magnetic field applied to the ferrite core is configured in a ring-like shape so as to surround the ferrite core and the permanent magnets. Accordingly, the DC magnetic field applied to the ferrite core from the permanent magnets does not disperse to upper portions of the ferrite core and the permanent magnets. This allows the DC magnetic field to be applied to the ferrite core in an optimum state, that is, a uniform and stable state.

The shield conductor made of a nonmagnetic metal conductive material is disposed directly above the ferrite core and the permanent magnets to cover an opening portion of the magnetic yoke. This configuration prevents external magnetic influences (a change of electric characteristics of the nonreciprocal circuit device) and unnecessary radiation (leakage) of electromagnetic waves to the outside. Furthermore, since the shield conductor is made of a nonmagnetic metal conductive material, the DC magnetic field is not changed or is not deteriorated by the shield conductor. This configuration does not interfere with stable application of the DC magnetic field to the ferrite core.

In particular, in the nonreciprocal circuit device according to preferred embodiments of the present invention, the center electrodes preferably include a first center electrode and a second center electrode, the first center electrode having a first end electrically connected to a first input/output port and a second end electrically connected to a second input/output port, the second center electrode intersecting with the first center electrode in an electrically insulated state and having a first end electrically connected to the second input/output port and a second end electrically connected to a third port for ground. A first matching capacitor is preferably connected to the first center electrode in parallel, a second matching capacitor is preferably connected to the second center electrode in parallel, and a terminating resistor is preferably connected in parallel to the first center electrode. The ferrite core preferably has a substantially rectangular-parallelepiped shape and the second center electrode may be wound around the ferrite core so that the second center electrode is wound around an axis that is substantially parallel to longer sides of the ferrite core two or more times. This configuration obtains a compact lumped parameter isolator.

In the nonreciprocal circuit device according to preferred embodiments of the present invention, the shield conductor may be grounded or may not be grounded. When the shield conductor is not grounded, an inductance Q of the center electrodes is improved, the insertion loss is slightly improved, and the device can be operated in a slightly wider bandwidth. When the shield conductor is grounded, the leakage of the electromagnetic waves is slightly reduced.

The shield conductor is preferably made of a nonmagnetic metal conductive film on a dielectric substrate. The conductive film may be formed by etching and other suitable methods on the dielectric substrate with high accuracy. Accordingly, the dielectric substrate functions as a flow passage for a high-frequency magnetic flux to thereby prevent deterioration of the insertion loss. Furthermore, since the opening areas are provided in the shield conductor with no open areas being disposed in the dielectric substrate, the dielectric substrate prevents foreign substances from entering the interior of the magnetic yoke. In addition, when compared to use of a metal plate attached to the ferrite and the permanent magnets, use of the shield conductor made of a nonmagnetic metal conductive film enables the distance between the ferrite core and the shield conductor to be relatively constant, that is, a variation ratio of the distance is reduced. Unlike with the use of an adhesive bond or an adhesive agent, use of the shield conductor made of a nonmagnetic metal conductive film does not substantially change the thickness of the dielectric plate. Consequently, electric constants of the center electrodes are maintained constant and variations of the electric characteristics are minimized.

The shield conductor is preferably made of a copper foil provided on the dielectric substrate. A copper foil without having been subjected to treatment may be used, but a copper foil having been subjected to Au flash coating after Ni coating as a rust-proofing treatment is preferably used. Ni is not a nonmagnetic material. However, since a copper foil including a small amount of Ni (a Ni-coating copper foil) reaches magnetic saturation due to a magnetic field applied from the permanent magnets of the nonreciprocal circuit device, Ni can be used as a nonmagnetic material.

Since the center electrodes are made of the conductive film on the main surfaces of the ferrite core, the center electrodes can be formed with high accuracy. Accordingly, a compact center electrodes assembly which facilitates coupling is obtained.

The shield conductor preferably has an opening area at a position facing at least one of the shorter sides of the ferrite core. A magnetic flux tends to be concentrated at positions directly above the shorter sides of the substantially rectangular-parallelepiped-shaped ferrite core, resulting in generation of an eddy current on the shield conductor at the positions directly above the shorter sides of the ferrite core. In particular, in a configuration in which the second center electrode is wound around the ferrite core two or more times, the eddy current is more likely to be generated. However, since the opening area is provided on the shield conductor at the position directly above the shorter sides of the ferrite core, the generation of the eddy current is prevented and the insertion loss is reduced.

The opening area may include a plurality of slits, or may have a variety of shapes, such as a cross shape and a substantially circular shape. When the total area of the opening area is about 5% to about 20% of a planar projection area of the ferrite core, the leakage of electromagnetic waves is properly prevented and a magnetic shield function is not deteriorated. Note that the total area means a total area of one of the opening areas when the opening areas are disposed at two positions.

A gap between the shield conductor and an uppermost portion of the ferrite core may be set to be at least about 10% of a height of the ferrite core. This configuration suppresses the deterioration of the insertion loss to a minimum.

Since a communication apparatus according to preferred embodiments of the present invention includes the above-described nonreciprocal circuit device, suitable electric characteristics due to the nonreciprocal circuit device are obtained, and therefore, the communication apparatus providing stable performance is obtained.

According to preferred embodiments of the present invention, external magnetic influences are eliminated by the shield conductor, and unnecessary radiation of electromagnetic waves from the nonreciprocal circuit device is prevented. Since the shield conductor is made of the nonmagnetic metal conductive material, the DC magnetic field applied from the permanent magnets to the ferrite core is not changed or deteriorated, and therefore, a stable DC magnetic field is maintained. In particular, since the opening areas are provided on the shield conductor at least at a position directly above the center of one of the shorter sides of the ferrite core, the generation of the eddy current on the shield conductor at this position is prevented and the insertion loss is reduced.

Other features, elements, steps, characteristics and advantages of the present invention will become more apparent from the following detailed description of preferred embodiments of the present invention with reference to the attached drawings.

DETAILED DESCRIPTION OF PREFERRED EMBODIMENTS

Preferred embodiments of a nonreciprocal circuit device and a communication apparatus according to the present invention will now be described with reference to the accompanying drawings.

Nonreciprocal Circuit Device

Figure 1:
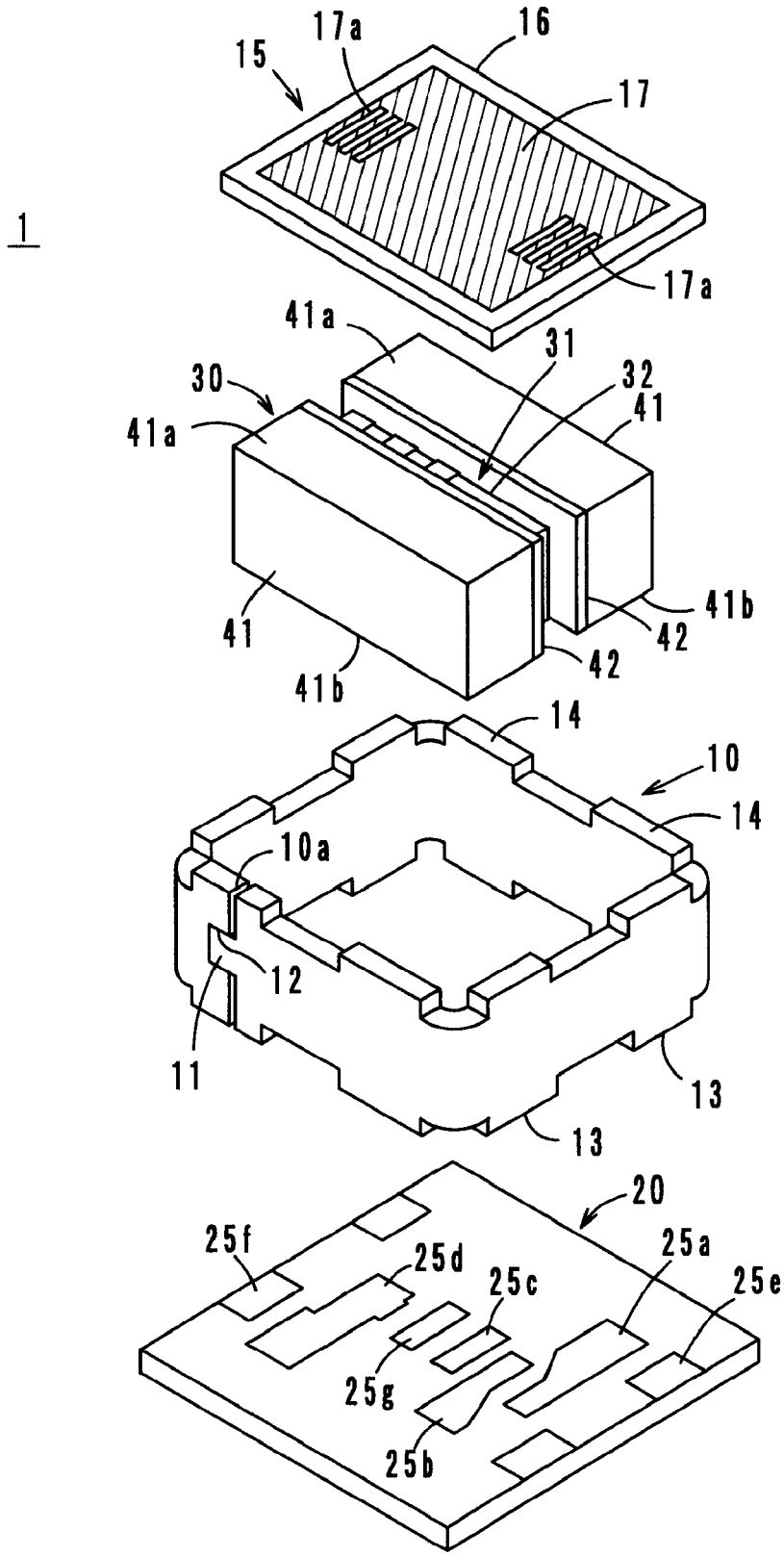
FIG. 1 is an exploded perspective view of a preferred embodiment of a nonreciprocal circuit device (two-port isolator) according to the present invention.

Preferred embodiments of a nonreciprocal circuit device according to the present invention will now be described. FIG. 1 is an exploded perspective view of a two-port isolator 1 according to a preferred embodiment of the present invention. The two-port isolator 1 is a lumped parameter isolator and includes a center electrode assembly 31 having a magnetic yoke 10, an electromagnetic shield plate 15, a circuit substrate 20, and a ferrite core 32, and permanent magnets 41 which apply a DC magnetic field to the ferrite core 32.

Figure 3:
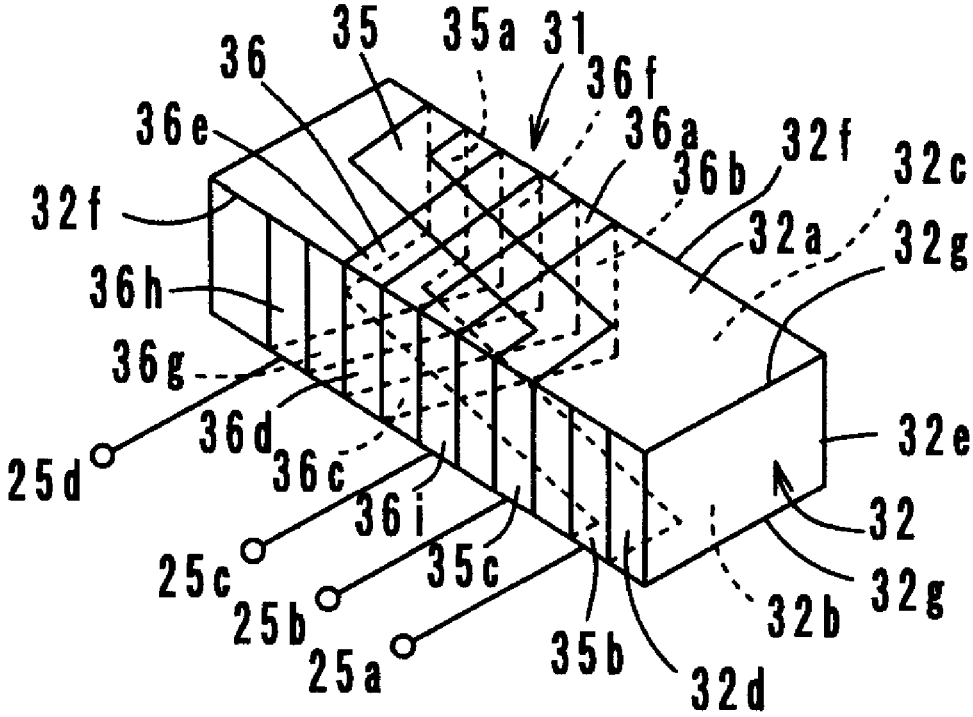
FIG. 3 is a perspective view of a center electrode assembly of the two-port isolator.

The center electrode assembly 31, as shown in FIG. 3, includes a first center electrode 35 and a second center electrode 36 which are provided on main surfaces 32*a* and 32*b* of the microwave ferrite core 32 and are electrically insulated from each other. The ferrite core 32 has a substantially rectangular solid shape having the first main surface 32*a* and the second main surface 32*b* arranged substantially in parallel and is disposed on the circuit substrate 20 such that the first main surface 32*a* and the second main surface 32*b* are disposed substantially perpendicular to the circuit substrate 20. The main surfaces 32*a* and 32*b* have substantially rectangular shapes. In this arrangement, an upper surface 32*c* of the ferrite core 32 has shorter sides 32*e* and longer sides 32*f* (in plan view), and the main surfaces 32*a* and 32*b* have shorter sides 32*g* and the longer sides 32*f* (in front view).

The permanent magnets 41 are adhered by an adhesive layer 42 to the main surfaces 32*a* and 32*b* so that a magnetic field is applied to the main surfaces 32*a* and 32*b* in a substantially perpendicular direction, whereby a ferrite-magnet assembly 30 is formed. The main surfaces of the ferrite core 32 refer to surfaces that are substantially perpendicular to a direction in which a DC magnetic field is applied by the pair of permanent magnets 41. A configuration of the center electrode assembly 31 and a circuit configuration will be described in detail below.

The magnetic yoke 10 is made of a ferromagnetic material, such as a soft iron. The magnetic yoke 10 is plated with a rust-proof coating and has a ring-like frame shape so as to surround the center electrode assembly 31 and the permanent magnets 41 on the circuit substrate 20 where side surfaces of the magnetic yoke 10 are substantially perpendicular to a surface of the circuit substrate 20.

The ring-like magnetic yoke 10 is fabricated, at first, by punching out a strip which is in a state in which the magnetic yoke 10 is unfolded by being separated at a fitting portion 10*a*. Then a protrusion 11 and a recess 12 are firmly attached to each other and a hemming process is performed to obtain a ring-like shape. Since the protrusion and the recess are joined by fitting, the magnetic yoke 10 can be firmly constructed without overlapping at a joint portion to have a compact configuration and an excellent rust-proof coating. Since no gap is present at the joint portion, the electric resistance and the magnetic resistance are reduced, electric/magnetic shielding performance is improved, and the shape is made stable, with the result that the electric property has no variation.

Note that the magnetic yoke 10 is not limited to this configuration, and may be formed by joining two separate base bodies into a ring shape. The joining method may be welding, particularly, spot welding such as resistance welding or laser welding, instead of the hemming process. In this case, the separate yokes 10 are expected to have an excellent finish by using barrel plating to apply the rust-proof coating. Ag coating is preferably applied on a Cu base coating to contribute to the realization of a low insertion loss.

The magnetic yoke 10 preferably has a substantially rectangular or square-ring shape in plan view since the ferrite-magnet assembly 30 is formed so as to be cube-shaped when using a production method in which the ferrite-magnet assembly 30, which will be described later, is cut out of a motherboard. In a gap between the ferrite-magnet assembly 30 and the yoke 10, the difference between a largest gap portion and a smallest gap portion is reduced. Consequently, the uniformity of the DC magnetic field applied to the ferrite core 32 from the permanent magnets 41 is improved. A yoke 10 having a substantially symmetric square-ring shape eliminates consideration of orientation when the yoke 10 is mounted on the circuit substrate 20, resulting in simplification of the manufacturing process.

The magnetic yoke 10 is joined to terminal electrodes provided on the circuit substrate 20 by soldering, heat soldering, Ag epoxide-based conductive adhesive agent or other suitable method. A bottom surface 13 of the yoke 10 can be adhered to the circuit substrate 20. In this case, improvement of the joint strength is expected. Since a heat-resistant adhesive agent does not melt even if the joint soldering melts due to heat generated when the isolator 1 is mounted on the substrate by reflow soldering, the yoke 10 does not move due to a magnetic force of the magnets 41, resulting in improved reliability. As an adhesive agent in this case, a one-component epoxy adhesive agent provides excellent workability, excellent strength, and excellent heat resistance.

The electromagnetic shield plate 15 is arranged to cover the ferrite core 32 and the permanent magnets 41 from directly above. The electromagnetic shield plate 15 has a shield conductor 17 (a shaded portion in FIG. 1) made of a nonmagnetic metal conductive material on a dielectric substrate 16. The shield conductor 17 substantially covers the entire opening portion of the magnetic yoke 10.

A glass epoxy resin is used as the dielectric substrate 16 and a copper foil is used as the shield conductor 17, for example, to make a copper-clad glass epoxy substrate. The shield conductor 17 made of the copper foil may be formed by etching using photolithography with high accuracy and opening areas 17*a*, which will be described later, may be formed with ease. A copper foil without having been subjected to treatment may be used. However, a copper foil subjected to Au flash coating after Ni coating as a rust-proofing treatment is preferably used. Ni is not a nonmagnetic material. However, the saturation magnetic flux density of the Ni coating is low and the density reaches saturation under a particular magnetic field (at least about 0.01T (about 100 Gauss)) used in the nonreciprocal circuit device, for example. Therefore, the effective magnetic permeability of the Ni coating is extremely low. Accordingly, the shield conductor 17 of the nonmagnetic material functions as a nonmagnetic material even when the shield conductor 17 is covered by the Ni coating. Specifically, even if a magnetic metal coating such as a Ni coating having a thickness of approximately 10 μm is applied on the shield conductor 17, the function of preventing the insertion loss from deteriorating remains effective.

The electromagnetic shield plate 15 is adhered to the upper surfaces 41*a* of the permanent magnets 41 using an adhesive agent, or may be adhered using an adhesive sheet or an adhesive tape. Alternatively, the electromagnetic shield plate 15 may be adhered to upper edge surfaces 14 of the magnetic yoke 10. The shield conductor 17 is configured so that an edge portion of the dielectric substrate 16 remains exposed to ensure a non-contact state of the shield conductor 17 with the ground. If contact of the shield conductor 17 with the magnetic yoke 10 intermittently occurs, the electric characteristics of the isolator 1 will vary. The electromagnetic shield plate 15 having no shield conductor 17 at its periphery facilitates a cutout operation of the electromagnetic shield plate 15 from the motherboard, for example. In particular, a cutting speed at a time of dicing is increased, resulting in a reduction of processing costs. In addition, since the metal part is not cut, deterioration of a dicing cutter due to clogging is avoided.

Figure 2:
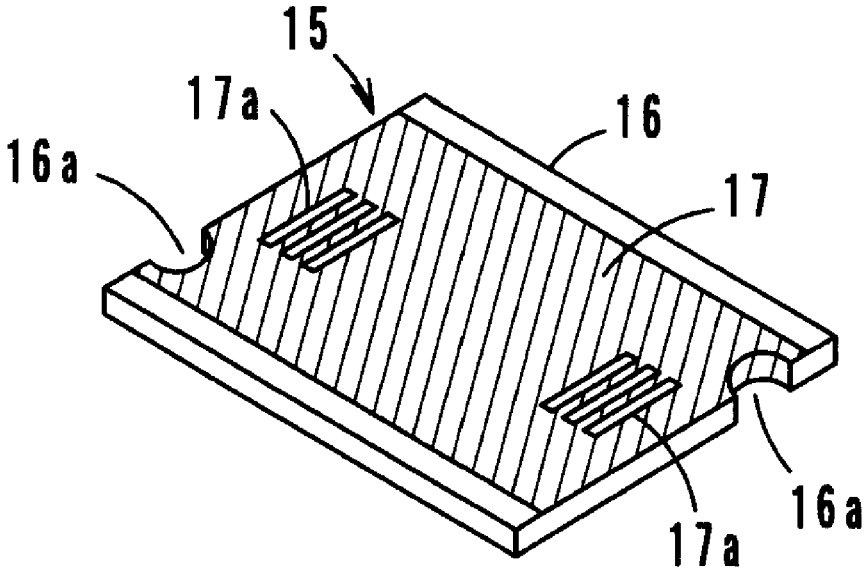
FIG. 2 is a perspective view of a modification of an electromagnetic shield plate.

When the shield conductor 17 is brought into contact with the ground, as shown in FIG. 2, cutouts 16*a* are formed at edges of the dielectric substrate 16 and the shield conductor 17 is expanded up to the cutouts 16*a* so that the electromagnetic shield plate 15 is coupled to the upper edge surfaces of the magnetic yoke 10 in this portion by soldering. The magnetic yoke 10 is grounded, and consequently, the shield conductor 17 is also grounded.

In the present preferred embodiment, since the magnetic yoke 10 has a ring-like shape so as to surround side surfaces of the ferrite-magnet assembly 30, the DC magnetic field applied to the ferrite core 32 from the pair of permanent magnets 41 does not disperse to an upper portion of the ferrite core 32. This allows the DC magnetic field to be applied to the ferrite core 32 in an optimum state, that is, a uniform and stable state. The shield conductor 17 substantially covering the entire opening portion of the magnetic yoke 10 is disposed directly above the ferrite-magnet assembly 30. The configuration makes it possible for the isolator 1 to avoid external magnetic influences to ensure that the electric characteristics remain stable and to prevent electromagnetic waves from radiating unnecessarily to the outside. Since the shield conductor 17 is made of a nonmagnetic metal conductive material, the DC magnetic field is not changed or deteriorated by the shield conductor 17. This configuration allows stable application of the DC magnetic field to the ferrite core 32.

The shield conductor 17 may be a conductive metal plate. Furthermore, the shield conductor 17 may be a thin metal plate, such as a copper plate or a solid nickel silver sheet, which is subjected to etching or punch pressing to be made into a desired configuration. When one such thin metal plate is used, an epoxide-based adhesive sheet, an acrylic two-sided adhesive tape or other suitable adhesive is attached to the bottom surface of the thin metal plate to adhere the thin metal plate to the upper surface of the ferrite-magnet assembly 30. Use of an adhesive sheet or an adhesive tape is more preferable than use of an adhesive agent since the use of an adhesive sheet or an adhesive tape enables the distance between the shield conductor (the conductive metal plate) 17 and the ferrite core 32 and the distance between the shield conductor 17 and the magnets 41 to be more accurately maintained. Accordingly, the variation of the electric characteristics is prevented.

Figure 4A:
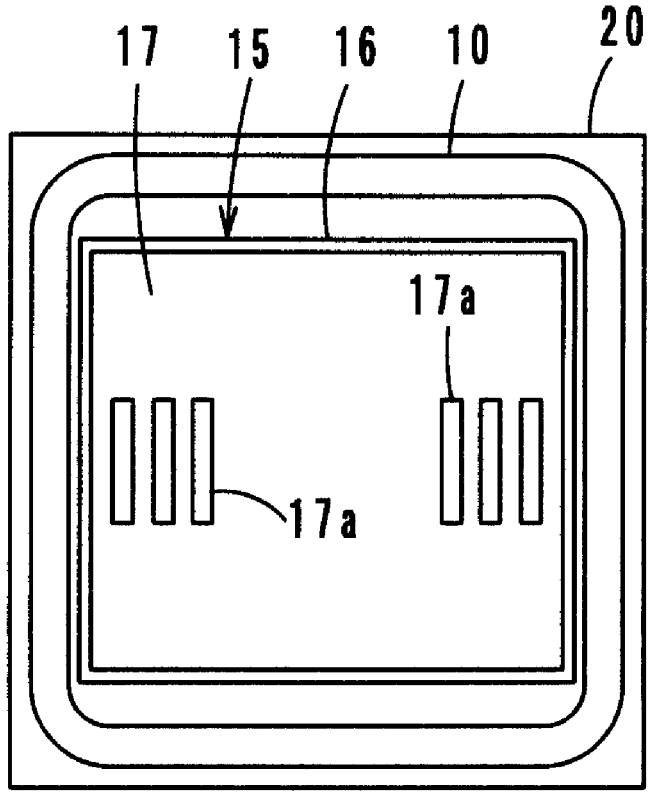
FIG. 4A shows a plan view of the two-port isolator.
Figure 4B:
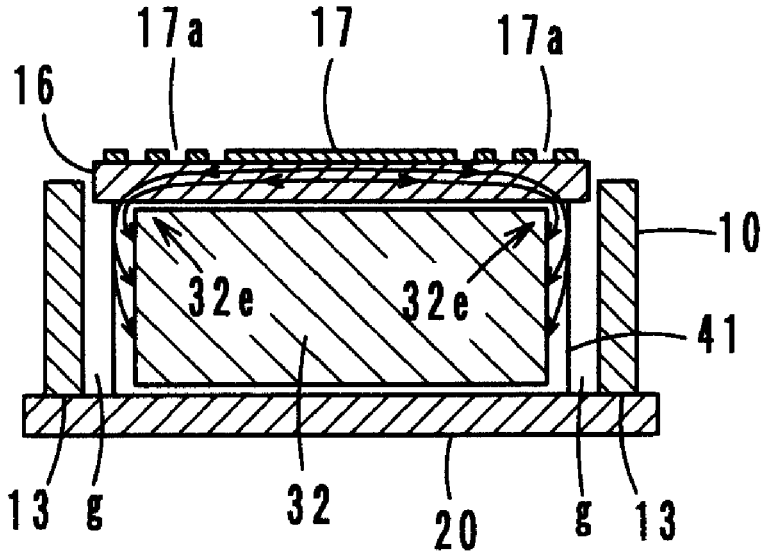
FIG. 4B shows a central sectional view.

The shield conductor 17 includes opening areas 17*a* having a plurality of narrow slits disposed substantially in parallel with each other (refer to FIGS. 4A and 4B). The opening areas 17*a* are positioned in the shield conductor 17 so as to face the shorter sides 32*e* forming the upper surface 32*c* of the ferrite core 32. A magnetic flux tends to be concentrated at positions directly above the shorter sides 32*e* of the substantially rectangular-parallelepiped-shaped ferrite core 32 (refer to FIG. 4B), resulting in the generation of an eddy current on the shield conductor 17 at the positions directly above the shorter sides 32*e* of the ferrite core 32. In particular, in a configuration in which the second center electrode 36 is wound around the ferrite core 32 two or more times, the eddy current is more likely to be generated. However, the opening areas 17*a* provided in the above-described portions of the shield conductor 17 break a path of a high-frequency eddy current, resulting in a reduction of an insertion loss as will be apparent from FIG. 11, for example, described below. Observed values such as a value of an insertion loss will be described later.

In the related art, a device including a magnetic yoke having holes or openings can be seen, but in this preferred embodiment, the yoke 10 does not have holes or openings. The yoke defines a magnetic circuit having a DC magnetic field. If holes and openings are provided in the yoke, the strength of the DC magnetic field is deteriorated, and therefore, the magnets must be larger, resulting in an increase in the size of the isolator 1. The device according to the present preferred embodiment produces an excellent magnetic shield effect, prevents an unnecessary eddy current from being generated, and accordingly, realizes a low insertion loss without an adverse effect such as increasing the size of the isolator 1.

In the present preferred embodiment, since the dielectric substrate 16 includes the shield conductor 17, the dielectric substrate 16 functions as a flow passage for a high-frequency magnetic flux (refer to FIG. 4B). This configuration prevents deterioration of the insertion loss. Furthermore, since the opening areas 17*a* are provided in the shield conductor 17 without opening areas being provided in the dielectric substrate 16, the dielectric substrate 16 functions as a cover member to prevent foreign substances from entering the interior of the magnetic yoke 10.

Figure 5A:
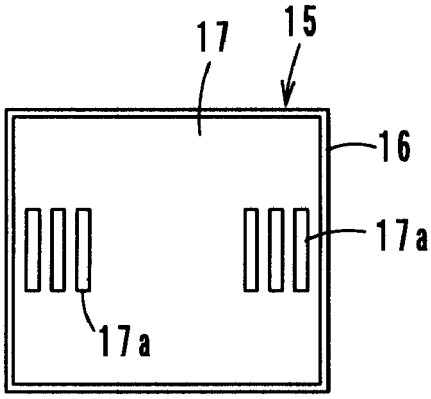
FIGS. 5A-5F include plan views of various shapes of opening areas formed on a shield conductor.
Figure 5E:
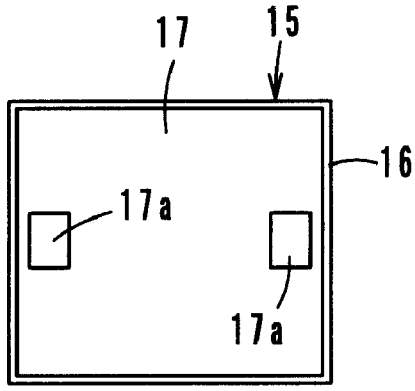
Figure 5B:
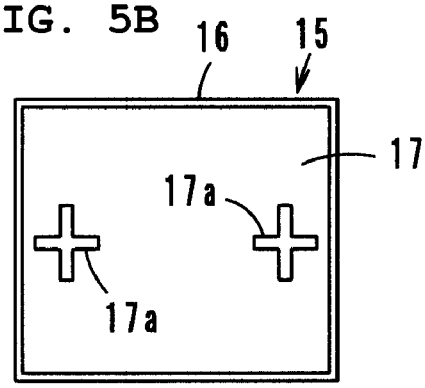
Figure 5F:
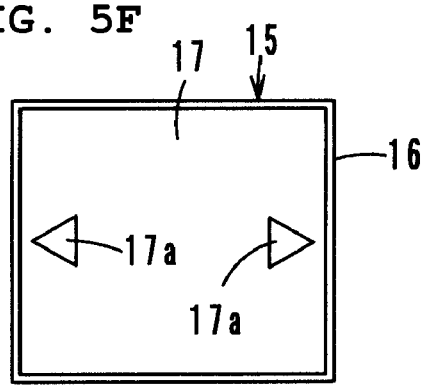

Various shapes of the opening areas 17*a* are illustrated in FIGS. 5A to 6D. FIG. 5A illustrates the plurality of slits described above which are arranged substantially parallel to the shorter sides 32*e* of the ferrite core 32. FIG. 5B illustrates cross-shaped openings. FIG. 5C illustrates a plurality of slits which are arranged substantially parallel to the longer sides 32*f* of the ferrite core 32. FIG. 5D illustrates substantially circular openings, FIG. 5E illustrates substantially rectangular openings, and FIG. 5F illustrates substantially triangular openings.

In FIGS. 5A to 5F, the opening areas 17*a* are defined by holes in the shield conductor 17 isolated from the periphery thereof. However, the opening areas 17*a* may also be open to the outside of the shield conductor 17. As examples of such openings, substantially rectangular openings are shown in FIG. 6A, cross-shaped openings are shown in FIG. 6B, and substantially circular openings are shown in FIG. 6C. In FIG. 6D, opening areas 17*a* having a plurality of slits are provided on opposite sides of the shield conductor 17, and in addition, a circular opening area 17*b* is provided on the left side. The opening area 17*b* also defines a marker enabling an input side and an output side of the isolator 1 to be distinguished.

Since the opening areas 17*a* described above are provided in the vicinity of positions where the eddy current substantially flows, the flow of the eddy current is interrupted and electric consumption is reduced. Obviously, the opening areas 17*a* may have shapes other than those of the described examples. The opening areas 17*a* may be configured, for example, in an elongated shape so as to extend across substantially the entire length of the shield conductor 17 directly above a center portion of the ferrite core 32. The opening areas having elongated shapes may have opposite edges that are closed or open to the outside.

Figure 5C:
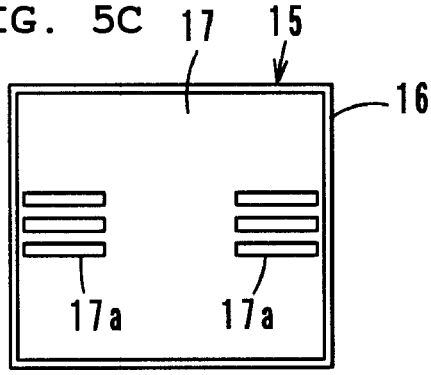
Figure 5D:
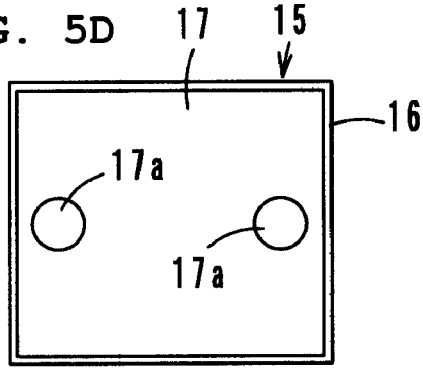
Figure 6A:
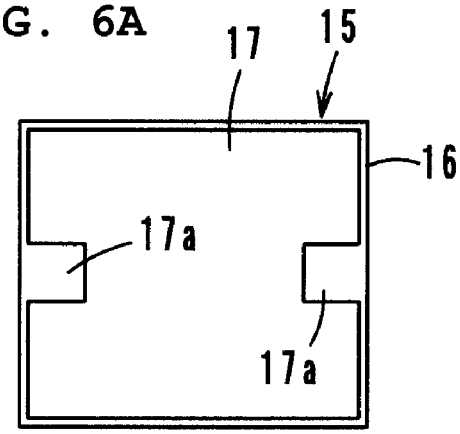
FIGS. 6A-6D include plan views of various shapes of the opening areas formed on the shield conductor.
Figure 6B:
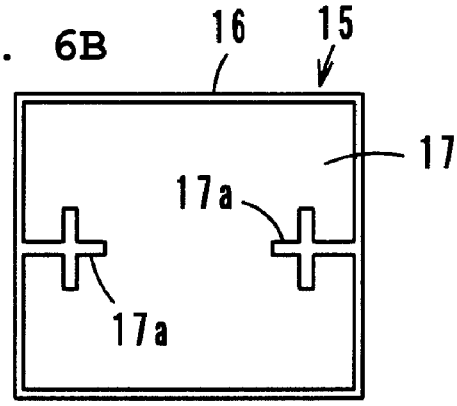
Figure 6C:
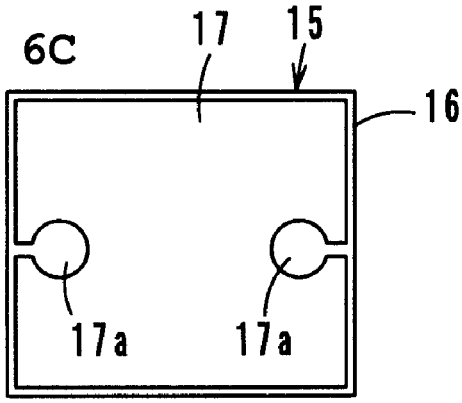
Figure 6D:
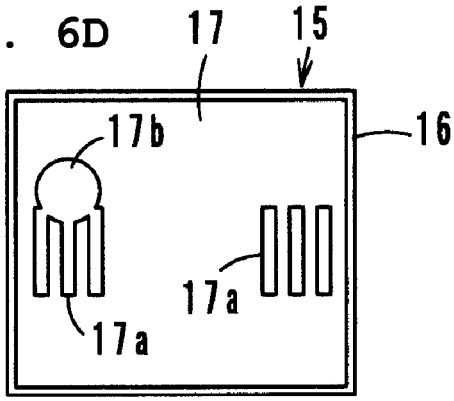

The opening areas 17*a* having a plurality of slits as shown in FIGS. 5A and 5C are arranged so that the width of each of the slits is less than the wavelength of an electromagnetic wave to be used. This effectively prevents the electromagnetic wave from leaking. The opening areas 17*a* shown in FIGS. 6A to 6C which are open to the outside may effectively interrupt the flow of the eddy current, but have a disadvantage in terms of the preventing the leakage of the electromagnetic wave. In addition, a sufficiently small gap between the shield conductor 17 and the magnetic yoke 10 may suppress the leakage of the electromagnetic waves to a minimum.

When the magnetic yoke 10 is brought into contact with the ferrite core 32 or the permanent magnet 41, the electric characteristics are deteriorated. Therefore, as shown in FIG. 4B, a gap g is preferably provided between inner surfaces of the magnetic yoke 10 and end surfaces of the ferrite core 32 or the permanent magnet 41.

A configuration of the ferrite-magnet assembly 30 will now be described. As shown in FIG. 3, the first center electrode 35 is disposed on the first main surface 32*a* of the ferrite core 32 such that the first center electrode 35 rises from the lower right to the upper left with a comparatively small angle with respect to the longer sides 32*f*. After rising to the upper left, the first center electrode 35 continues onto the second main surface 32*b* through a relay electrode 35*a* on the upper surface 32*c*. Then, the first center electrode 35 on the second main surface 32*b* can be seen to be overlapped with the first center electrode 35 on the first main surface 32*a* in a transparent view, and is connected to a connection electrode 35*b* formed on a lower surface 32*d*.

The second center electrode 36 is arranged as follows. A portion 36*a* corresponding to the 0.5th turn of the second center electrode 36 is inclined at a comparatively large angle with respect to the longer sides 32*f*, extends from the substantially center portion of the lower side to the upper left so as to intersect with the first center electrode 35, and continues onto the second main surface 32*b* through a relay electrode 36*b* on the upper surface 32*c*. Then, a portion 36*c* corresponding to the 1st turn of the second center electrode 36 is inclined leftwardly upward with a comparatively large angle on the second main surface 32*b* to intersect with the first center electrode 35. The lower end portion of the portion 36*c* corresponding to the 1st turn continues onto the first main surface 32*a* through a connection electrode 36*d* on the lower surface 32*d*. A portion 36*e* corresponding to the 1.5th turn of the second center electrode 36 intersects with the first center electrode 35 in parallel with the portion 36*a* corresponding to the 0.5th turn on the first main surface 32*a*, and continues onto the second main surface 32*b* through a relay electrode 36*f* on the upper surface 32*c*. A portion 36*g* corresponding to the 2nd turn of the second center electrode 36 intersects with the first center electrode 35 in parallel with the portion 36*c* corresponding to the 1st turn on the second main surface 32*b* and is connected to a connection electrode 36*h* on the lower surface 32*d*.

That is, the second center electrode 36 spirally winds twice around the ferrite core 32. Here, the number of turns is incremented by adding 0.5 turns each time the second center electrode 36 crosses the first main surface 32*a* or the second main surface 32*b*. Angles at which the center electrodes 35 and 36 cross each other are set as appropriate to control an input impedance and the insertion loss.

Figure 7:
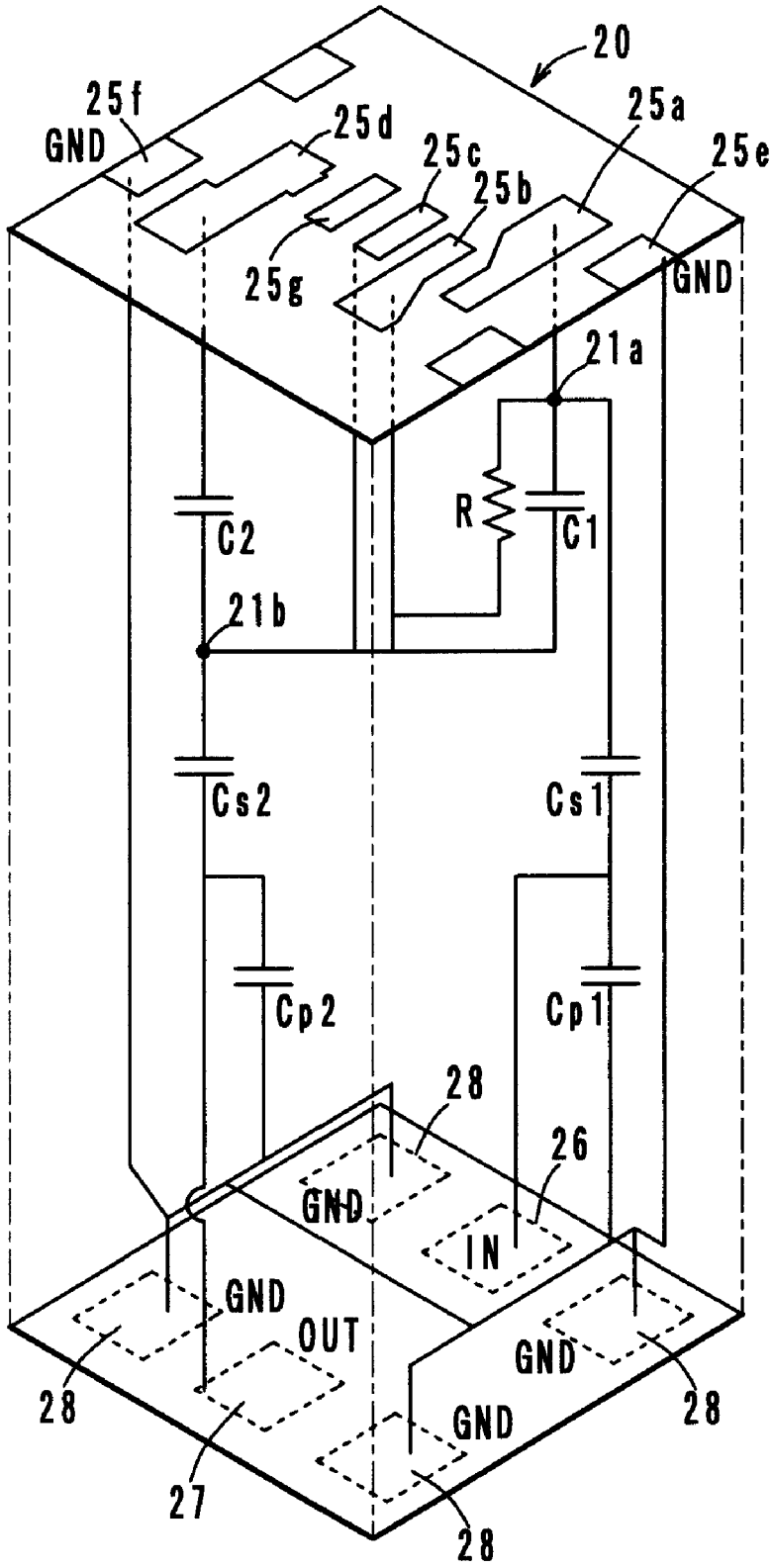
FIG. 7 is a block diagram of a circuit configuration in a circuit substrate of the two-port isolator.

The circuit substrate 20 is a ceramic laminate substrate such that prescribed electrodes are provided on a plurality of dielectric sheets and the sheets are laminated and sintered. As shown in FIG. 7, matching capacitors C1, C2, Cs1, Cs2, Cp1 and Cp2 and a terminating resistor R are incorporated in the circuit substrate 20. Terminal electrodes 25*a* to 25*g* are provided on an upper surface of the circuit substrate 20 and outer connection terminal electrodes 26, 27 and 28 are provided on a lower surface of the circuit substrate 20.

Figure 8:
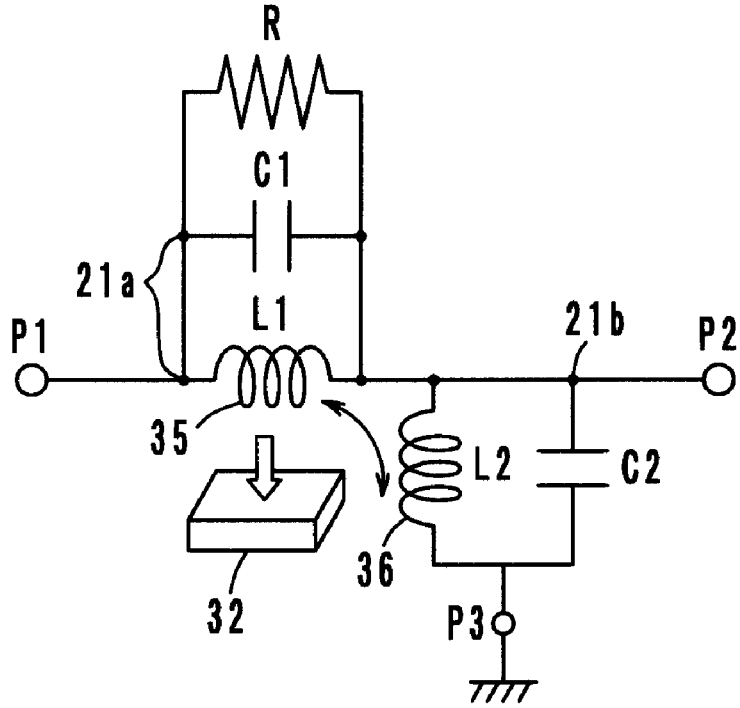
FIG. 8 is an equivalent circuit schematic of a first circuit example of the two-port isolator.
Figure 9:
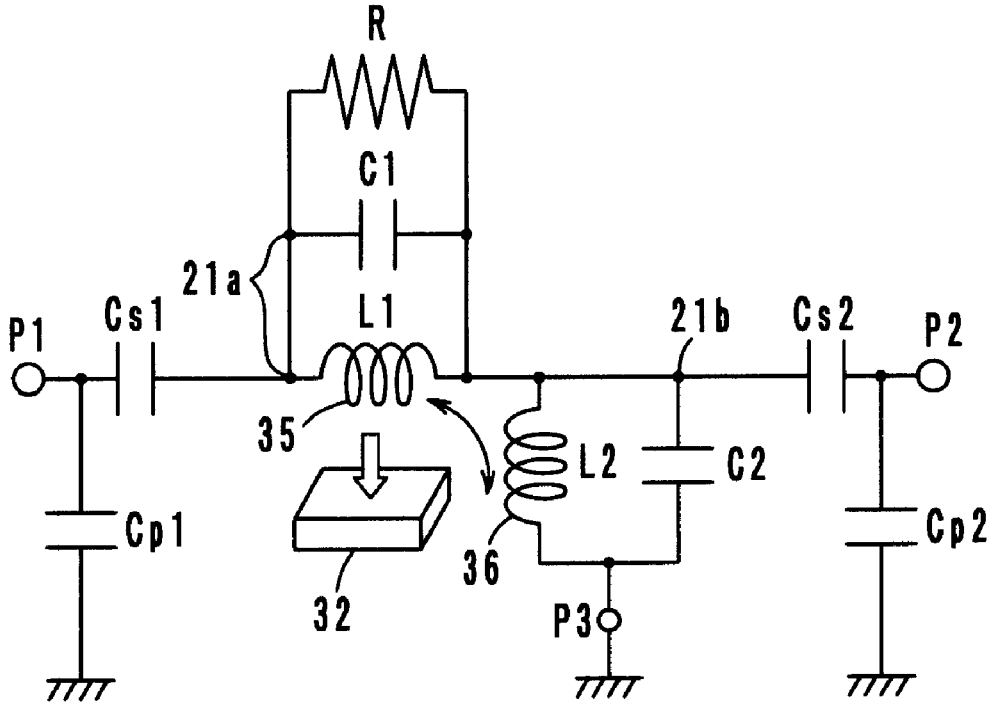
FIG. 9 is an equivalent circuit schematic of a second circuit example of the two-port isolator.

The connection relationships between matching circuit devices and the first and second center electrodes 35 and 36 are described with reference to FIG. 7 and equivalent circuits shown in FIGS. 8 and 9. The equivalent circuit included in FIG. 8 illustrates a first basic circuit in the nonreciprocal circuit device (two-port isolator 1) according to preferred embodiments of the present invention and the equivalent circuit in FIG. 9 illustrates a second basic circuit. FIG. 7 illustrates a configuration of the second basic circuit.

The external connection terminal electrode 26 provided on the lower surface of the circuit substrate 20 functions as an input port P1 and is connected through the matching capacitor Cs1 to a connection point 21*a* for connecting the matching capacitor C1 and the terminating resistor R. The connection point 21*a* is connected to one end of the first center electrode 35 through the terminal electrode 25*a* provided on the upper surface of the circuit substrate 20.

The other end of the first center electrode 35 is connected to the terminating resister R and the capacitors C1 and C2 through the connection electrode 35*c* and the terminal electrode 25*b* formed on the upper surface of the circuit substrate 20.

The external connection terminal electrode 27 provided on the lower surface of the circuit substrate 20 functions as an output port P2 and is connected through the matching capacitor Cs2 to a connection point 21*b* for connecting the capacitors C2 and C1.

A first connection electrode 36*i* of the second center electrode 36 (provided on the lower surface 32*d* of the ferrite core 32) is connected to the connection point 21*b* through the terminal electrode 25*c* provided on the upper surface on the circuit substrate 20. A second connection electrode 36*h* of the second center electrode 36 is connected to the external connection terminal electrode 28 provided on the lower surface of the circuit substrate 20 through the terminal electrode 25*d* provided on the upper surface of the circuit substrate 20. The external connection terminal electrode 28 also defines a ground port P3, and is connected to the yoke 10 through the terminal electrodes 25*e* and 25*f* provided on the upper surface of the circuit substrate 20.

The impedance control capacitor Cp1 is grounded and is connected to a connection point for connecting the input port P1 and the capacitor Cs1. Likewise, the impedance control capacitor Cp2 is grounded and is connected to a connection point for connecting the output port P2 and the capacitor Cs2.

The circuit substrate 20 and the yoke 10 are integrated with each other by soldering through the terminal electrodes 25*e* and 25*f*. Concerning the ferrite-magnet assembly 30, the connection electrodes 35*b*, 35*c*, 36*d*, 36*h* and 36*i* on the lower surface 32*d* of the ferrite core 32 are integrated with the terminal electrodes 25*a* to 25*d* and 25*g* on the circuit substrate 20 by soldering and the lower surfaces 41*b* of the permanent magnets 41 are integrated with the circuit substrate 20 preferably by an adhesive agent. The terminal electrode 25*g* to which the connection electrode 36*d* is connected is a dummy electrode.

A gap created in a joint portion of the ferrite-magnet assembly 30 and the circuit substrate 20 is preferably filled with a resin material having insulation properties and moisture resistance. This eliminates problems such as an insulation failure due to intrusion of water or foreign substances, resulting in improvement of reliability.

In the two-port isolator 1 having the above-described configuration, since the magnetic yoke 10 has a ring shape so as to surround the ferrite-magnet assembly 30 as described above, the DC magnetic field is applied to the ferrite core 32 in an optimum state, that is, a uniform and stable state. In addition, the configuration enables the isolator 1 to avoid the external magnetic influences to ensure that the electric characteristics remain stable and to prevent unnecessary electromagnetic waves from radiating to the outside. Since the shield conductor 17 is made of a nonmagnetic metal conductive material, the DC magnetic field is not changed or deteriorated by the shield conductor 17, resulting in stable application of the DC magnetic field to the ferrite core 32.

Since the pair of permanent magnets 41 having the same shape surface as each other so as to sandwich the ferrite core 32 having the first and second center electrodes 35 and 36 provided thereon, the pair of permanent magnets 41 generates a DC magnetic flux having excellent parallelism and a uniform magnetic field is applied to the ferrite core 32, whereby the electric characteristics of the isolator 1, such as the insertion loss, are improved.

The ferrite core 32 is disposed on the circuit substrate 20 such that the main surfaces 32*a* and 32*b* are disposed substantially perpendicular to the circuit substrate 20. The permanent magnets 41 are disposed on the circuit substrate 20 such that the magnetic field is applied substantially perpendicular to the main surfaces 32*a* and 32*b* of the ferrite core 32.

That is, since the ferrite core 32 and the permanent magnets 41 are longitudinally disposed in the substantially perpendicular direction on the circuit substrate 20, the height of the pair of permanent magnets 41 is not increased even when thicknesses of the permanent magnets 41 are increased to obtain a stronger magnetic field, resulting in a reduction of the size and the height of the permanent magnets 41.

As illustrated in the second circuit example (refer to FIG. 9), the additional matching capacitor Cs1 is interposed between the input port P1 and the connection point 21*a* for connecting the first center electrode 35 and the capacitor C1, and the additional matching capacitor Cs2 is interposed between the output port P2 and the connection point 21*b* for connecting the center electrodes 35 and 36. This configuration enables an impedance of the isolator 1 to be matched to an impedance (50 Ω) of a device connected to the isolator 1 even when an inductance of the center electrodes 35 and 36 is set larger to improve electric characteristics in a wideband. Note that this effect can also be obtained by inserting either one of the matching capacitors Cs1 and Cs2.

Since the center electrodes 35 and 36 are made of conductive films on the main surfaces 32*a* and 32*b* of the ferrite core 32, and therefore, the shapes of the center electrodes 35 and 36 are defined with high accuracy, the isolators 1 having uniform electric characteristics can be mass-produced. The relay electrodes 35*a*, 36*b* and 36*f* and the connection electrodes 35*b*, 35*c*, 36*d*, 36*h* and 36*i* are also made of conductive films. The permanent magnets 41 are adhered through the adhesive layer 42 to the main surfaces 32*a* and 32*b* of the ferrite core 32 (refer to FIG. 1). The adhesive layer 42 can be replaced by a two-sided adhesive sheet.

Effects such as reduction of the insertion loss due to the presence of the shield conductor 17 in the isolator 1 will now be described according to measured values.

Figure 10:
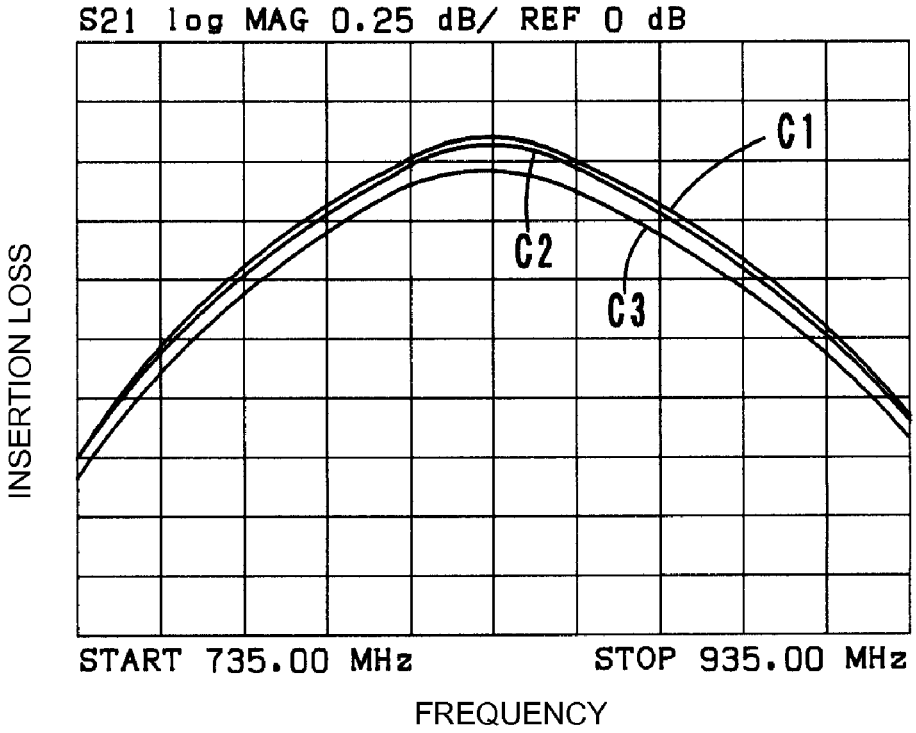
FIG. 10 is a graph showing the dependency of insertion losses on the presence/absence of the shield conductor.

FIG. 10 shows the dependency of insertion losses on the presence/absence of the shield conductor 17. In FIG. 10, a curve C1 shows insertion loss characteristics in a case where a shield conductor 17 is not disposed, a curve C2 shows insertion loss characteristics in a case where a shield conductor 17 having opening areas 17*a* is disposed, and a curve C3 shows insertion loss characteristics in a case where a shield conductor 17 without opening areas 17*a* is disposed. The opening areas 17*a* have the plurality of slits as shown in FIG. 5A.

Table 1 shows insertion loss and transition of a center operating frequency for each of the shapes of the opening areas 17*a* provided in the shield conductor 17 in an 830 MHz-band isolator. In this specification, the transition of a center operating frequency means the transition (shift) from a center operating frequency before a ground plate is positioned close to a top portion of the isolator at a separation of approximately 0.03 mm to a center operating frequency after the ground plate is positioned close to the top portion of the isolator at a separation of approximately 0.03 mm. The shapes of the opening areas 17*a* are shown in the column "Drawings". For the purpose of comparison, characteristics in a case where a shield conductor is not disposed are shown in the top of the columns, whereas characteristics in a case where a shield conductor without opening areas is provided are shown in the bottom of the columns.

TABLE 1

| Presence/Absence of Shield Conductor | Presence/Absence of Opening Areas | Drawings | Insertion Loss (dB) | Transition of Center Operating Frequency (MHz) |
|---|---|---|---|---|
| Absence | | | 0.40 | 40 |
| Presence | Presence | 5(A) | 0.41 | 3 |
| Presence | Presence | 5(B) | 0.42 | 2 |
| Presence | Presence | 5(C) | 0.41 | 3 |
| Presence | Presence | 5(D) | 0.42 | 3 |
| Presence | Presence | 5(E) | 0.42 | 3 |
| Presence | Presence | 5(F) | 0.42 | 3 |
| Presence | Presence | 6(A) | 0.41 | 6 |
| Presence | Presence | 6(B) | 0.41 | 5 |
| Presence | Presence | 6(C) | 0.41 | 5 |
| Presence | Presence | 6(D) | 0.41 | 4 |
| Presence | Absence | | 0.55 | 0 |

As shown in Table 1, the shield conductor 17 having the opening areas 17*a* suppresses an adverse effect of the insertion loss to a range from about 0.01 dB to about 0.02 dB, which is negligible. With most of the shapes of the opening areas, the transitions of the center operating frequency are about 3 MHz or less. Accordingly, the shield conductor function as a shield conductor is not deteriorated.

Figure 11:
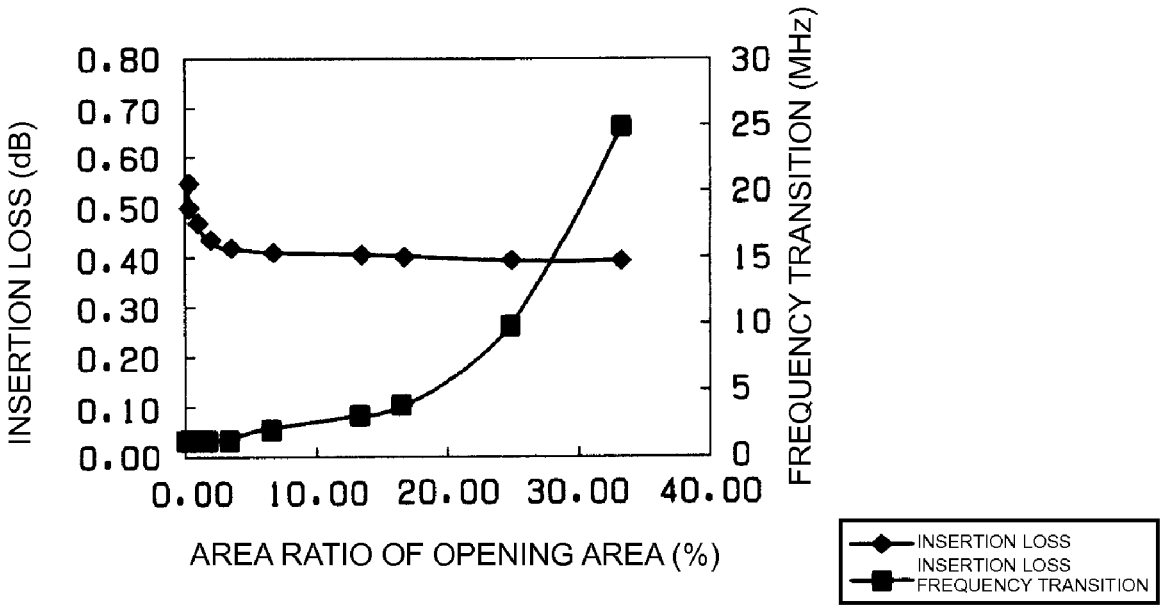
FIG. 11 is a graph showing transitions of an insertion loss and a center operating frequency according to the shape of an opening area formed on the shield conductor.

Table 2 and FIG. 11 show insertion losses and transitions of the center operating frequency for different sizes of the opening areas 17*a*. The area ratio means a ratio of the total area of one of the left and right opening areas 17*a* to a projected area of the ferrite core 32 on a plane. Here, the opening areas 17*a* having the plurality of slits shown in FIG. 5A are used.

TABLE 2

| Total Opening Area ($mm^2$) | Ferrite Projection Area ($mm^2$) | Area Ratio (%) | Insertion Loss (dB) | Transition of Center Operating Frequency (MHz) |
|---|---|---|---|---|
| 0.0010 | 0.6 | 0.17 | 0.55 | 1 |
| 0.0020 | 0.6 | 0.33 | 0.50 | 1 |
| 0.0050 | 0.6 | 0.83 | 0.47 | 1 |
| 0.0100 | 0.6 | 1.67 | 0.44 | 1 |
| 0.0200 | 0.6 | 3.33 | 0.42 | 1 |
| 0.0400 | 0.6 | 6.67 | 0.41 | 2 |
| 0.0800 | 0.6 | 13.33 | 0.41 | 3 |
| 0.1000 | 0.6 | 16.67 | 0.40 | 4 |
| 0.1500 | 0.6 | 25.00 | 0.40 | 10 |
| 0.2000 | 0.6 | 33.33 | 0.40 | 25 |

As shown in Table 2 and FIG. 11, when the area ratio is at least about 5%, deterioration of the insertion losses is negligible. However, when the area ratio becomes at least about 20%, the transition of the center operating frequency becomes significantly large, resulting in deterioration of an electromagnetic shield function. Accordingly, the total area of one of the left and right opening areas 17*a* is preferably equal to about 5% to about 20% of a planar projection area of the ferrite core 32.

Figure 12A:
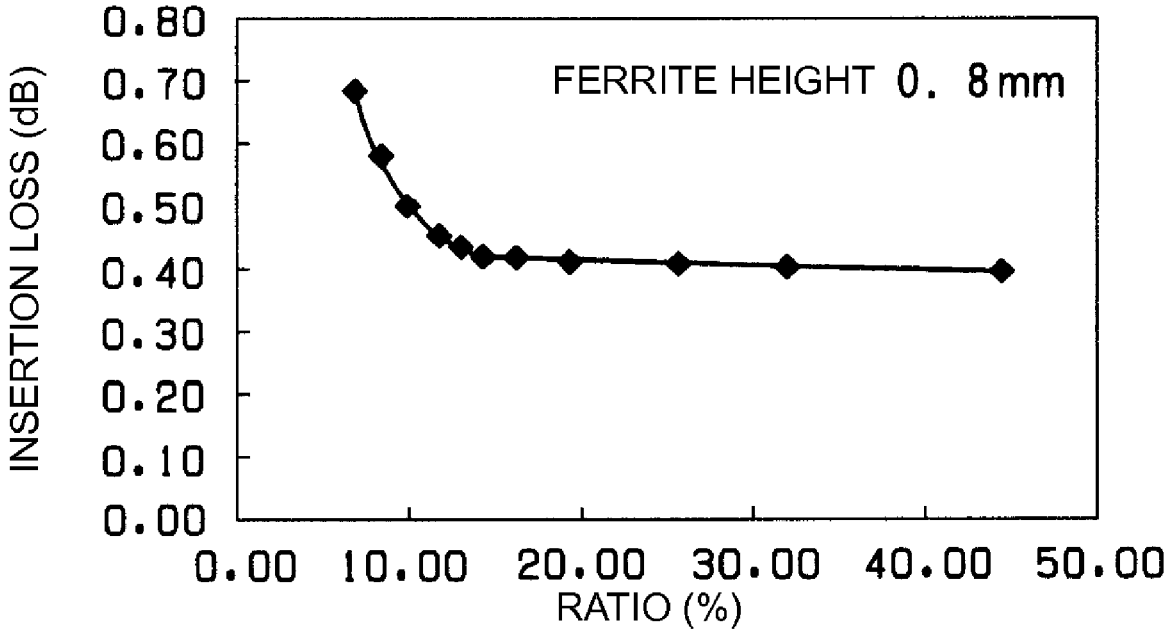
FIGS. 12A and 12B include graphs showing the dependency of insertion losses on a gap between the shield conductor and a ferrite core.
Figure 12B:
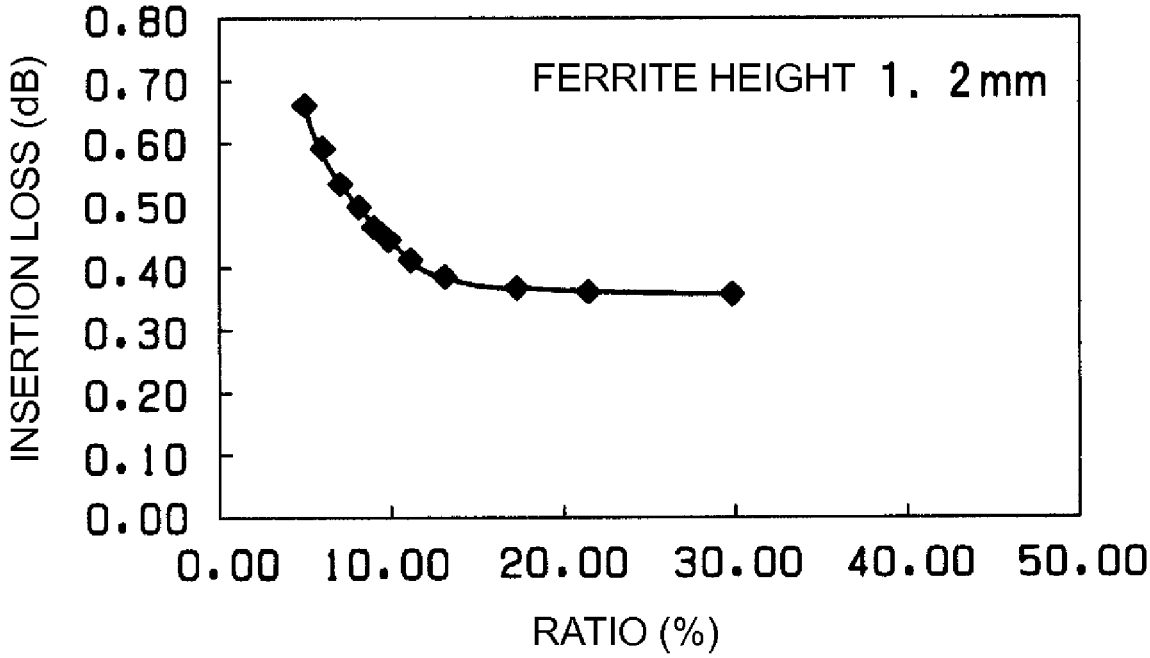

Table 3 and FIGS. 12A and 12B show the dependency of insertion losses on a gap between the shield conductor 17 and an uppermost portion of the ferrite core 32. The ratio means a ratio of the gap to a height of the ferrite core 32. The opening areas 17*a* having the plurality of slits shown in FIG. 5A are used. FIG. 12A shows an insertion loss in a case where the ferrite core 32 has a height of about 0.8 mm, and FIG. 12B shows an insertion loss in a case where the ferrite core 32 has a height of about 1.2 mm.

TABLE 3

| Gap between Shield Conductor and Ferrite (mm) | Height of Ferrite (mm) | Ratio (%) | Insertion Loss (dB) |
|---|---|---|---|
| 0.0500 | 0.8 | 6.25 | 0.69 |
| 0.0625 | 0.8 | 7.81 | 0.58 |
| 0.0750 | 0.8 | 9.38 | 0.50 |
| 0.0900 | 0.8 | 11.25 | 0.45 |
| 0.1000 | 0.8 | 12.50 | 0.43 |
| 0.1100 | 0.8 | 13.75 | 0.42 |
| 0.1250 | 0.8 | 15.63 | 0.41 |
| 0.1500 | 0.8 | 18.75 | 0.41 |
| 0.2000 | 0.8 | 25.00 | 0.41 |
| 0.2500 | 0.8 | 31.25 | 0.41 |
| 0.3500 | 0.8 | 43.75 | 0.40 |
| 0.0500 | 1.2 | 4.17 | 0.65 |
| 0.0625 | 1.2 | 5.21 | 0.58 |
| 0.0750 | 1.2 | 6.25 | 0.52 |
| 0.0900 | 1.2 | 7.50 | 0.48 |
| 0.1000 | 1.2 | 8.33 | 0.45 |
| 0.1100 | 1.2 | 9.17 | 0.43 |
| 0.1250 | 1.2 | 10.42 | 0.40 |
| 0.1500 | 1.2 | 12.50 | 0.37 |
| 0.2000 | 1.2 | 16.67 | 0.36 |
| 0.2500 | 1.2 | 20.83 | 0.35 |
| 0.3500 | 1.2 | 29.17 | 0.35 |

As shown in Table 3 and FIGS. 12A and 12B, the larger the gap, the smaller the deterioration of the insertion loss. However, when the ratio exceeds about 10%, little difference can be seen in terms of the effect, that is, the deterioration of the insertion losses can be negligible. Accordingly, the gap between the shield conductor 17 and the uppermost portion of the ferrite core 32 is preferably set to be at least about 10% of the height of the ferrite core 32.

In the foregoing preferred embodiment, the shield conductor 17 is disposed on the upper surface of the dielectric substrate 16 to obtain the effective gap. If the shield conductor 17 is disposed on the bottom surface of the dielectric substrate 16, the gap between the shield conductor 17 and the upper surface of the ferrite core 32 is not sufficient, thus leading to an increase in the deterioration of the insertion loss.

Communication Apparatus

Figure 13:
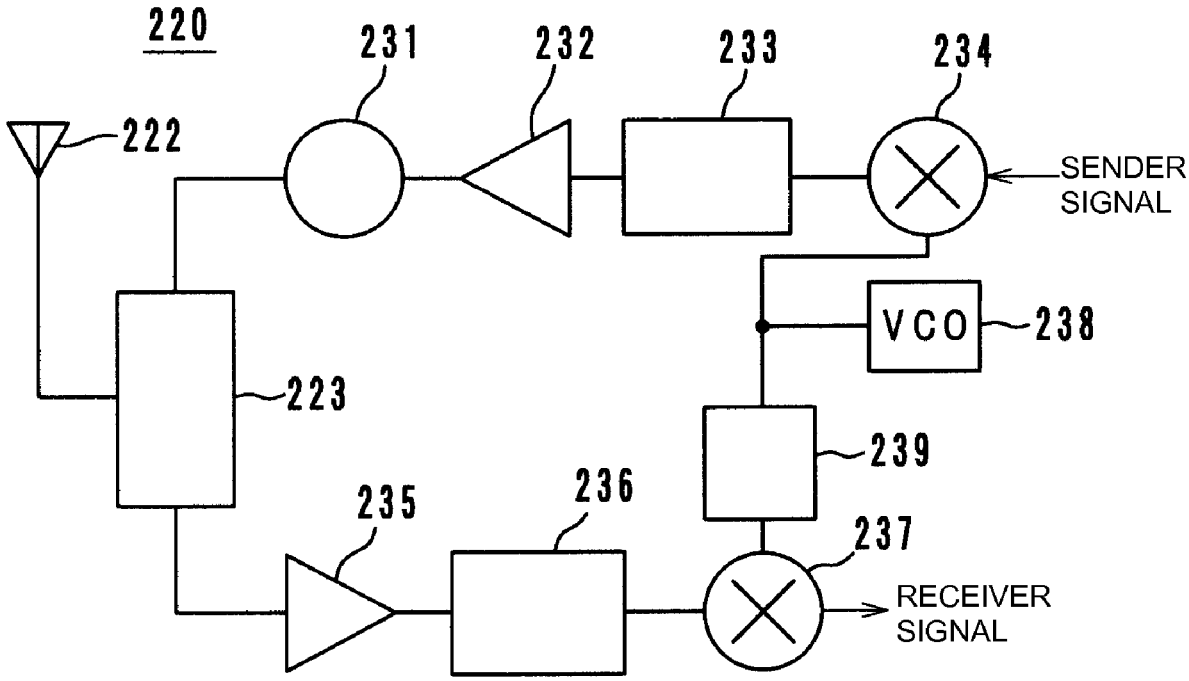
FIG. 13 is a block diagram of a preferred embodiment of a communication apparatus according to the present invention.

A description of a communication apparatus according to a preferred embodiment of the present invention will be made by taking a cellular telephone as an example. FIG. 13 is a block diagram of an electric circuit of an RF portion of a cellular telephone 220. In the figure, 222 denotes an antenna element, 223 denotes a duplexer, 231 denotes a sender isolator, 232 denotes a sender amplifier, 233 denotes a sender interstage band-pass filter, 234 denotes a sender mixer, 235 denotes a receiver amplifier, 236 denotes a receiver interstage band-pass filter, 237 denotes a receiver mixer, 238 denotes a voltage-controlled oscillator (VCO), and 239 denotes a local band-pass filter.

As a sender isolator 231, the two-port isolator 1 may be used. Since the isolator 1 is used, suitable electric characteristics and a cellular telephone providing stable performance are obtained.

The nonreciprocal circuit device and the communication apparatus according to the present invention are not limited to the preferred embodiments described above, and various modifications may be made without departing from the gist of the present invention.

For example, a north pole and a south pole of each of the permanent magnets 41 may be inverted to change an input port P1 into an output port P2 and vice versa. In the preferred embodiments described above, all of the matching circuit devices are incorporated in the circuit substrate. Alternatively, the circuit substrate may be provided with an external chip inductor and an external capacitor. In addition, the center electrodes may have arbitrary shapes and at least one of the center electrodes may be branched into two.

As described above, the present invention is suitably used for a nonreciprocal circuit device, such as an isolator and a circulator operating in a microwave band. The present invention is especially advantageous in that a DC magnetic field applied to a ferrite core from permanent magnets is stably maintained, external magnetic influences are eliminated, and unnecessary radiation of electromagnetic waves to the outside is prevented.

While preferred embodiments of the present invention have been described above, it is to be understood that variations and modifications will be apparent to those skilled in the art without departing the scope and spirit of the present invention. The scope of the present invention, therefore, is to be determined solely by the following claims.

What is claimed is:

1. A nonreciprocal circuit device comprising:

permanent magnets;

a ferrite core to which a direct-current magnetic field is applied from the permanent magnets;

a plurality of center electrodes disposed on the ferrite core;

a circuit substrate; and a magnetic yoke; wherein the plurality of center electrodes are disposed on main surfaces of the ferrite core so as to intersect with one another and are electrically insulated from one another;

the ferrite core and the permanent magnets are disposed substantially in parallel so that main surfaces thereof face each other and are substantially perpendicular to a surface of the circuit substrate;

the magnetic yoke has a ring-like shape so as to surround the ferrite core and the permanent magnets with surfaces thereof substantially perpendicular to the surface of the circuit substrate;

a shield conductor made of a nonmagnetic metal conductive material is disposed directly above the ferrite core and the permanent magnets to cover an opening portion of the magnetic yoke; and the shield conductor includes an opening area at a position facing at least one of shorter sides of the ferrite core.

2. The nonreciprocal circuit device according to claim 1, wherein the center electrodes include a first center electrode and a second center electrode, the first center electrode having a first end electrically connected to a first input/output port and a second end electrically connected to a second input/output port, the second center electrode intersecting with the first center electrode in an electrically insulated state and having a first end electrically connected to the second input/output port and a second end electrically connected to a third port for ground;

a first matching capacitor is connected to the first center electrode in parallel, a second matching capacitor is connected to the second center electrode in parallel, and a terminating resistor is connected to the first center electrode in parallel; and the ferrite core has a substantially rectangular-parallelepiped shape and the second center electrode is wound around the ferrite core so that the second center electrode is wound around an axis that is substantially parallel to longer sides of the ferrite core at least two times.

3. The nonreciprocal circuit device according to claim 1, wherein the shield conductor is not grounded.

4. The nonreciprocal circuit device according to claim 1, wherein the center electrodes are made of a conductive film provided the main surfaces of the ferrite core.

5. The nonreciprocal circuit device according to claim 1, wherein a gap between the shield conductor and an uppermost portion of the ferrite core is set to be at least about 10% of a height of the ferrite core.

6. A communication apparatus comprising the nonreciprocal circuit device according to claim 1.

7. The nonreciprocal circuit device according to claim 1, wherein a total area of the opening area is about 5% to about 20% of a planer projection area of the ferrite core.

8. The nonreciprocal circuit device according to claim 1, wherein the shield conductor is made of a nonmagnetic metal conductive film provided on a dielectric substrate.

9. The nonreciprocal circuit device according to claim 8, wherein the shield conductor is made of a copper foil provided on the dielectric substrate.

10. The nonreciprocal circuit device according to claim 9, wherein Ni and Au coatings are provided on the copper foil.

11. The nonreciprocal circuit device according to claim 1, wherein the opening area includes a plurality of slits.

12. The nonreciprocal circuit device according to claim 11, wherein a total area of the opening area is about 5% to about 20% of a planer projection area of the ferrite core.

13. The nonreciprocal circuit device according to claim 11, wherein a gap between the shield conductor and an uppermost portion of the ferrite core is set to be at least about 10% of a height of the ferrite core.

14. The nonreciprocal circuit device according to claim 1, wherein the opening area has a cross shape.

15. The nonreciprocal circuit device according to claim 14, wherein a total area of the opening area is about 5% to about 20% of a planer projection area of the ferrite core.

16. The nonreciprocal circuit device according to claim 14, wherein a gap between the shield conductor and an uppermost portion of the ferrite core is set to be at least about 10% of a height of the ferrite core.

17. The nonreciprocal circuit device according to claim 1, wherein the opening area has a substantially circular shape.

18. The nonreciprocal circuit device according to claim 17, wherein a total area of the opening area is about 5% to about 20% of a planer projection area of the ferrite core.

19. The nonreciprocal circuit device according to claim 17, wherein a gap between the shield conductor and an uppermost portion of the ferrite core is set to be at least about 10% of a height of the ferrite core.

* * * * *